US010153086B2

(12) United States Patent
Lee

(10) Patent No.: US 10,153,086 B2
(45) Date of Patent: Dec. 11, 2018

(54) GUIDING DEVICE FOR STATOR OF AUTOMATIC WIRE WINDING MACHINE

(71) Applicant: Ming-Chang Lee, Taipei (TW)

(72) Inventor: Ming-Chang Lee, Taipei (TW)

( * ) Notice: Subject to any disclaimer, the term of this patent is extended or adjusted under 35 U.S.C. 154(b) by 493 days.

(21) Appl. No.: 15/071,225

(22) Filed: Mar. 16, 2016

(65) Prior Publication Data

US 2017/0271078 A1 Sep. 21, 2017

(51) Int. Cl.
*H01F 41/082* (2016.01)

(52) U.S. Cl.
CPC ..... *H01F 41/082* (2016.01)

(58) Field of Classification Search
CPC ..... H01F 41/082; H02K 15/08–15/095
See application file for complete search history.

(56) References Cited

U.S. PATENT DOCUMENTS

2010/0301154 A1* 12/2010 Mugelli ..... H02K 15/0075 242/432.2
2015/0074985 A1* 3/2015 Ohno ..... H02K 15/064 29/596
2017/0264174 A1* 9/2017 Lee ..... H02K 15/095

FOREIGN PATENT DOCUMENTS

GB 781926 A * 8/1957 ..... B65H 57/00

* cited by examiner

*Primary Examiner* — Sang K Kim
*Assistant Examiner* — Nathaniel L Adams

(57) ABSTRACT

A guiding device for a stator of an automatic wire winding machine contains: a post, a cylinder, a sleeve, a cover, two springs, and three movable arms. The post includes a driven portion, an elongated hole, three grooves, and three bolts. The cylinder includes a through hole, two projections, two first apertures, a limiter, three second apertures, and three shafts. The sleeve is fitted with the post and includes two trenches. The cover includes an eyelet and fits with and moves on the post. One of the two springs abuts against the sleeve and pushes the cover to move, and another of the two springs also abuts against the sleeve and pushes the cylinder to move reversely. Each movable arm includes a hook portion arranged on a first end thereof and includes a fork portion formed on a second end thereof.

5 Claims, 16 Drawing Sheets

GUIDING DEVICE FOR STATOR OF AUTOMATIC WIRE WINDING MACHINE

FIELD OF THE INVENTION

The present invention relates to a guiding device for a stator of an automatic wire winding machine in which a robotic arm is close to a motor stator, and a fixing loop counterweights the motor stator, so the post supports the motor stator stably, when the guiding device guides wire in a wire winding process.

BACKGROUND OF THE INVENTION

A conventional wire winding device for a stator is employed to wind wires on or in a stator of a motor, but the wires cannot be fixed evenly as being winded on the stator.

The present invention has arisen to mitigate and/or obviate the afore-described disadvantages.

SUMMARY OF THE INVENTION

The primary objective of the present invention is to provide a guiding device for a stator of an automatic wire winding machine in which a robotic arm is close to a motor stator, and a fixing loop counterweights the motor stator, so the post supports the motor stator stably, when the guiding device guides wire in a wire winding process.

To obtain above-mentioned objective, a guiding device for a stator of an automatic wire winding machine provided by the present invention contains: a post, a cylinder, a sleeve, a cover, two springs, and three movable arms.

The post includes a driven portion extending outwardly from a bottom thereof, an elongated hole and three grooves which are arranged between the bottom and a top of the post, and three bolts fixed in the three grooves respectively.

The cylinder includes a through hole formed on a central position thereof so that the post moves reciprocately via the cylinder, the cylinder also includes two projections, and each projection extends out of a bottom of the cylinder so as to move with respect to the driven portion, the cylinder further including two first apertures proximate to a slot, a limiter retained with the cylinder and inserting through the elongated hole of the post, three second apertures formed on an inner wall thereof adjacent to a top of the cylinder and located outside the three grooves individually, and three shafts fixed in the three second apertures respectively;

The sleeve is fitted with the post and includes two trenches located on two ends thereof respectively.

The cover includes an eyelet and fitting with and moving on the post, and the cover is separated from the cylinder by the sleeve.

One of the two springs abuts against the sleeve and pushes the cover to move, and another of the two springs also abuts against the sleeve and pushes the cylinder to move reversely.

Each movable arm includes a hook portion arranged on a first end thereof and includes a fork portion formed on a second end thereof.

When said each movable arm is accommodated in each second aperture of the cylinder, the shaft inserts through said each movable arm, the hook portion is located outside the cylinder, and the fork portion enters into each groove so that each bolt is located on a central position of the fork portion, and the hook portion moves back and forth between a hooking position and a unhooking portion.

DETAILED DESCRIPTION OF THE PREFERRED EMBODIMENTS

Figure 1:
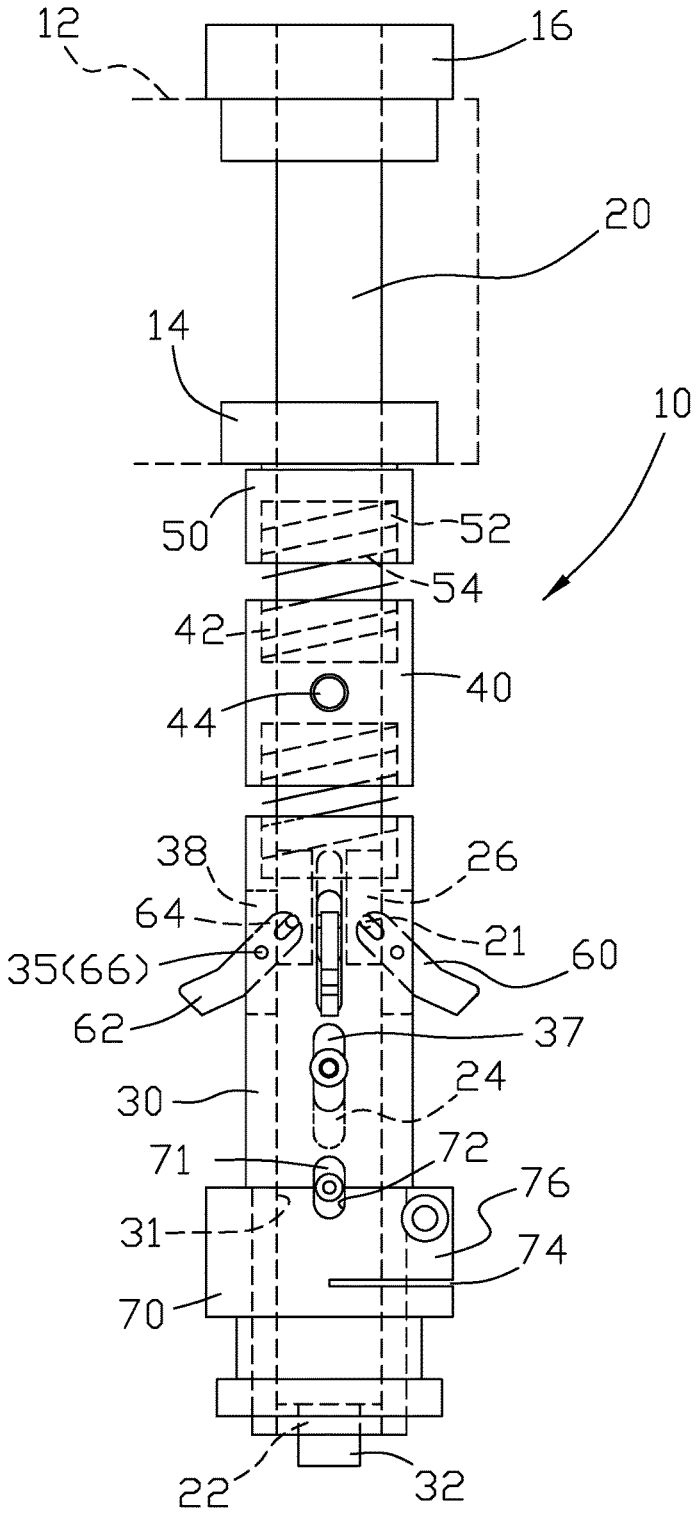
FIG. 1 is a perspective view showing the assembly of a guiding device for a stator of an automatic wire winding machine according to a preferred embodiment of the present invention.
Figure 2:
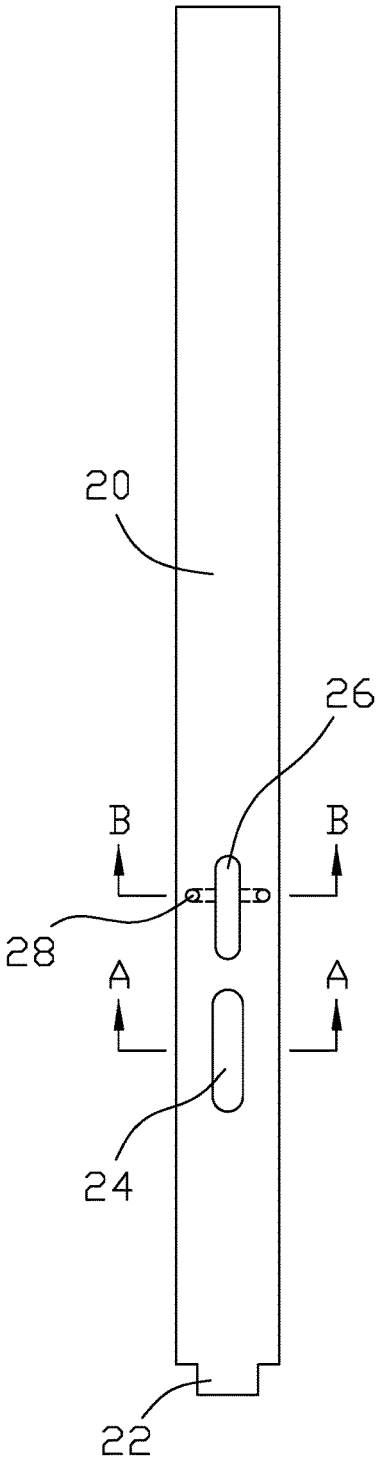
FIG. 2 is a side plan view showing the assembly of a post of the guiding device for the stator of the automatic wire winding machine according to the preferred embodiment of the present invention.
Figure 3:
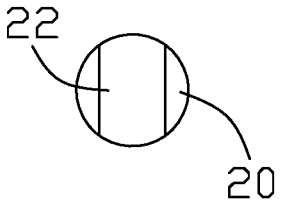
FIG. 3 is another side plan view showing the assembly of the post of the guiding device for the stator of the automatic wire winding machine according to the preferred embodiment of the present invention.
Figure 4:
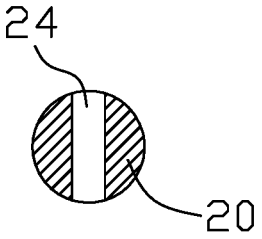
FIG. 4 is a cross sectional view showing the assembly of the post of the guiding device for the stator of the automatic wire winding machine according to the preferred embodiment of the present invention.
Figure 5:
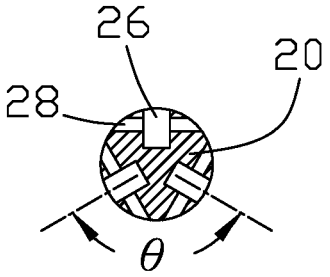
FIG. 5 is another cross sectional view showing the assembly of the post of the guiding device for the stator of the automatic wire winding machine according to the preferred embodiment of the present invention.
Figure 6:
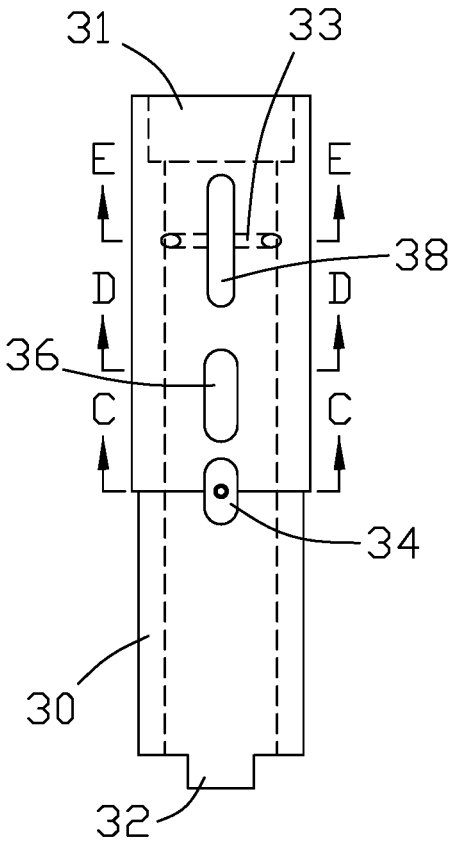
FIG. 6 is a side plan view showing the assembly of a cylinder of the guiding device for the stator of the automatic wire winding machine according to the preferred embodiment of the present invention.
Figure 7:
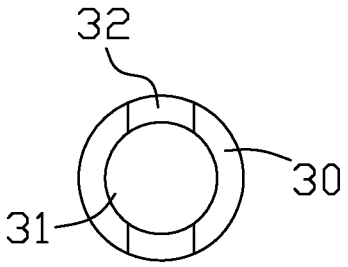
FIG. 7 is another side plan view showing the assembly of the cylinder of the guiding device for the stator of the automatic wire winding machine according to the preferred embodiment of the present invention.
Figure 8:
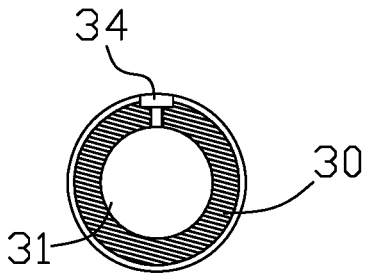
FIG. 8 is a cross sectional view showing the assembly of the cylinder of the guiding device for the stator of the automatic wire winding machine according to the preferred embodiment of the present invention.
Figure 9:
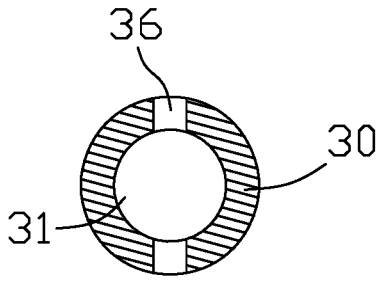
FIG. 9 is another cross sectional view showing the assembly of the cylinder of the guiding device for the stator of the automatic wire winding machine according to the preferred embodiment of the present invention.
Figure 10:
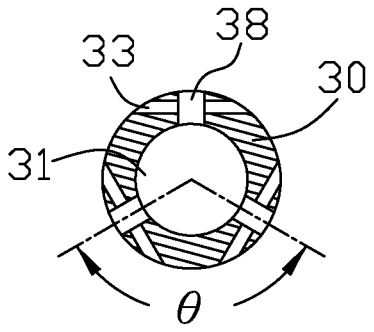
FIG. 10 is also another cross sectional view showing the assembly of the cylinder of the guiding device for the stator of the automatic wire winding machine according to the preferred embodiment of the present invention.

With reference to FIG. 1, a robotic arm 12 is fixed in or on an automatic wire winding machine (not shown) and is controlled by an automatic control system (not shown) to move or rotate in or on the automatic wire winding machine. The robotic arm 12 contains two support members which connect with a guiding device 10 capable of moving relative to the robotic arm 12.

The guiding device 10 according to a preferred embodiment of the present invention comprises a column 20, a cylinder 30, a sleeve 40, a cap 50, two springs 54, three movable arms 60, and a fixing loop 70.

Referring to FIGS. 2 to 5, the post 20 includes a rectangular driven portion 22 extending outwardly from a bottom thereof, an elongated hole 24 and three grooves 26 which are arranged between the bottom and a top of the post 20. The post 20 further includes a first orifice 28 formed on a peripheral wall of each groove 26.

As illustrated in FIG. 1, the post 20 is in connection with three bolts 21 and a connector 16, wherein each bolt 21 inserts through the first orifice 28 of the post 20 so as to fix in said each groove 26, wherein the top of the post 20 inserts through the two support members 14 so as to slidably connect with the robotic arm 12, the connector 16 is mounted on a position of the post 20 over the robotic arm 12 at which the post 20 starts movement relative to the robotic arm 12, and the connector 16 stops a removal of the post 20 from the robotic arm 12.

As illustrated in FIGS. 1 and 6 to 10, the cylinder 30 includes a through hole 31 formed in a fish eyelet shape on a central position of the cylinder 30, and a diameter of the through hole 31 is more than the post 20 so that the post 20 moves reciprocately via the cylinder 30. The cylinder 30 includes two projections 32, and each projection 32 extends out of a bottom of the cylinder 30 so as to move with respect to the driven portion 22.

The cylinder 30 also includes a slot 34 adjacent to the bottom thereof, two first apertures 36 proximate to the slot 34, and three second apertures 38 form on an inner wall thereof adjacent to a top of the cylinder 30. In addition, the cylinder 30 includes a limiter 37 retained with the two first apertures 36 and inserts through the elongated hole 24 of the post 20, and a width of the limiter 37 is less than a distance between two short sides of the elongated hole 24 so as to limit a moving range of the cylinder 30 relative to the post 20. The cylinder 30 also includes three third apertures 33, and each third aperture 33 passes through each second aperture 38 so that a shaft 35 fixes in said each third aperture 33 through said each second aperture 38. Furthermore, said each second aperture 38 is located outside said each groove 26.

Figure 13:
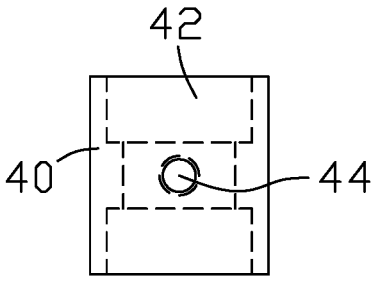
FIG. 13 is a side plan view showing the assembly of a sleeve of the guiding device for the stator of the automatic wire winding machine according to the preferred embodiment of the present invention.

With reference to FIGS. 1 and 13, the sleeve 40 includes two trenches 42 located on two ends thereof respectively. When the sleeve 40 is fitted with the post 20, a first screwing element (not shown) is locked in a threaded opening 44 on an outer wall of the sleeve 40 and forces the post 20 so as to fix the sleeve 40.

Figure 11:
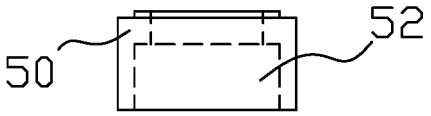
FIG. 11 is a side plan view showing the assembly of a cover of the guiding device for the stator of the automatic wire winding machine according to the preferred embodiment of the present invention.

Referring to FIGS. 1 and 11, the cover 50 includes an eyelet 52 and fits with and moves on the post 20, and the cover 50 is fixed between the robotic arm 12 and the sleeve 40 and is separated from the cylinder 30 by the sleeve 40.

One of the two springs 54 abuts against the sleeve 40 and pushes the cover 50 to move by which the post 20 is driven to move with respect to the robotic arm 12 until the connector 16 is sopped by the two support members 14. Another of the two springs 54 also abuts against the sleeve 40 and pushes the cylinder 30 to move reversely until the limiter 37 is stopped in the elongated hole 24.

Figure 12:
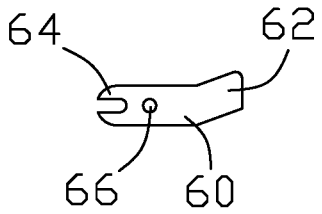
FIG. 12 is a side plan view showing the assembly of a movable arm of the guiding device for the stator of the automatic wire winding machine according to the preferred embodiment of the present invention.

As shown in FIGS. 1 and 12, each movable arm 60 includes a hook portion 62 arranged on a first end thereof, a fork portion 64 formed on a second end thereof, and a second orifice 66 defined on a central position thereof. When said each movable arm 60 is accommodated in said each second aperture 38 of the cylinder 30, the shaft 35 inserts through the second orifice 66 of said each movable arm 60, the hook portion 62 is located outside the cylinder 30, and the fork portion 64 enters into said each groove 26 so that said each bolt 21 is located on a central position of the fork portion 64, and the hook portion 62 moves back and forth between a hooking position and a unhooking portion.

Figure 14:
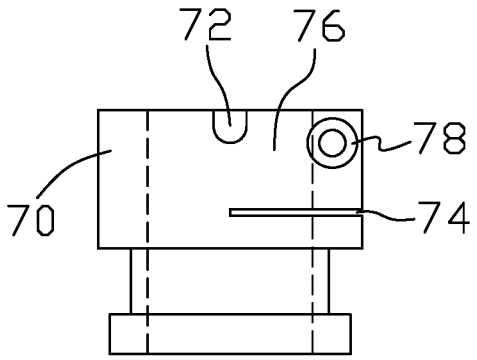
FIG. 14 is a side plan view showing the assembly of a fixing loop of the guiding device for the stator of the automatic wire winding machine according to the preferred embodiment of the present invention.
Figure 15:
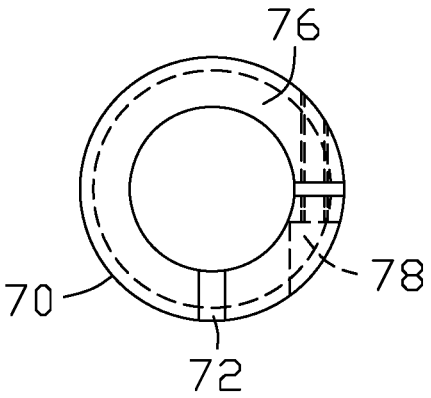
FIG. 15 is another side plan view showing the assembly of the fixing loop of the guiding device for the stator of the automatic wire winding machine according to the preferred embodiment of the present invention.

As illustrated in FIGS. 1, 14 and 15, the fixing loop 70 is fitted on the cylinder 30 and moves back and forth relative to the post 20. The fixing loop 70 includes a positioning trough 72 formed on a top thereof and flushing with the slot 34 of the cylinder 30 so as to accommodate a key 71 with the slot 30, and the key 71 is locked in the cylinder 30 by a second screwing element so as to stop a rotation of the fixing loop 70 around the cylinder 30.

The fixing loop 70 further includes a slit 74, a C-shaped clamping portion 76 defined between the slit 74 and the top of fixing loop 70, and two third orifices 78 arranged on a mouth of the clamping portion 76, wherein the clamping portion 76 is locked in the two third orifices 78 by a three screwing element so as to decrease a diameter of the clamping portion 76, thus fixing the fixing loop 70.

The guiding device 10 operates in a first travel and a second travel, the first travel represents the two springs 54 pushes the cover 50 and the sleeve 40 outwardly, and the second travel denotes the two springs 54 pushes the sleeve 40 and the cylinder 30 outwardly. Thereby, the two projections 32 of the cylinder 30 moves over the driven portion 22 of the post 20 so as to drive the hook portion 62 of said each movable arm 60 to locate at the unhooking portion.

Figure 16:
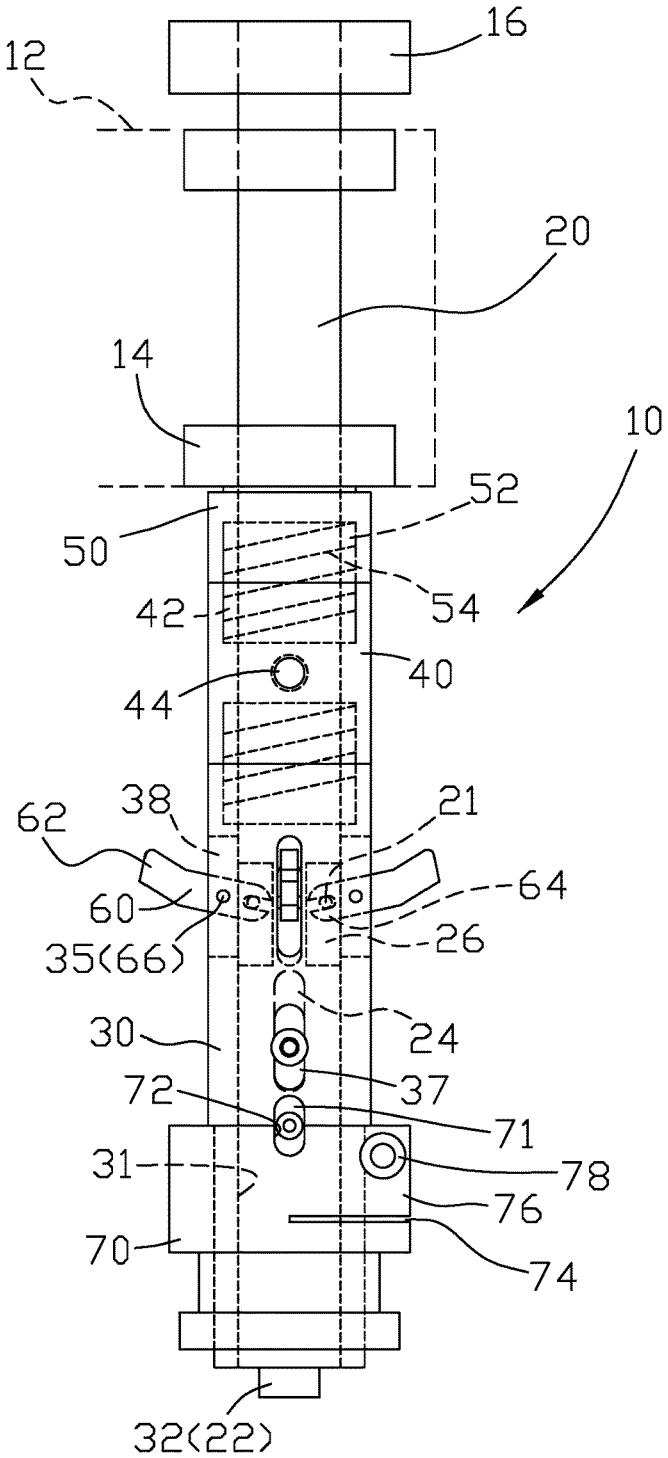
FIG. 16 is a side plan view showing the operation of the guiding device for the stator of the automatic wire winding machine according to the preferred embodiment of the present invention.

Referring to FIG. 16, when the two projections 32 are forced by a motor stator (not shown) to drive the cylinder 30 to move with respect to the post 20, a distance between the cylinder 30 and the sleeve 40 is zero so that the cylinder 30 and the sleeve 40 press the two springs 54, the two projections 32 are located abreast the driven portion 22, and the hook portion 62 of said each movable arm 60 maintains at the hooking portion.

In the second travel, the driven portion 22 and the two projections 32 actuate the post 20 and the cylinder 30 to continuously move upward until the sleeve 40 is biased against the cover 50 and to press the two springs 54 between the sleeve 40 and the cover 50.

Meantime, the robotic arm 12 is close to the motor stator, and the fixing loop 70 counterweights the motor stator, so the post 20 supports the motor stator stably as the guiding device 10 guides wire in a wire winding process.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A guiding device for a stator of an automatic wire winding machine comprising:

a post including a driven portion extending outwardly from a bottom thereof, an elongated hole and three grooves which are arranged between the bottom and a top of the post, and three bolts fixed in the three grooves respectively;

a cylinder including a through hole formed on a central position thereof so that the post moves reciprocately via the cylinder, the cylinder also including two projections, and each projection extending out of a bottom of the cylinder so as to move with respect to the driven portion, the cylinder further including two first apertures proximate to a slot thereof, a limiter retained with the cylinder and inserting through the elongated hole of the post, three second apertures formed on an inner wall thereof adjacent to a top of the cylinder and located outside the three grooves individually, and three shafts fixed in the three second apertures respectively;

a sleeve fitted with the post and including two trenches located on two ends thereof respectively;

a cover including an eyelet and fitting with and moving on the post, and the cover being separated from the cylinder by the sleeve;

two springs, one of which abuts against the sleeve and pushes the cover to move, and another of the two springs also abutting against the sleeve and pushing the cylinder to move reversely;

three movable arms, and each movable arm including a hook portion arranged on a first end thereof and a fork portion formed on a second end thereof;

wherein when said each movable arm is accommodated in each second aperture of the cylinder, the shaft inserts through said each movable arm, the hook portion is located outside the cylinder, and the fork portion enters into each groove so that each bolt is located on a central position of the fork portion, and the hook portion moves back and forth between a hooking position and a unhooking portion.

2. The guiding device for the stator of the automatic wire as claimed in claim 1, wherein the post further includes a connector, wherein the connector is mounted on a position of the post over the robotic arm at which the post starts movement relative to the robotic arm, and the connector stops a removal of the post from the robotic arm.

3. The guiding device for the stator of the automatic wire as claimed in claim 1 further comprising the fixing loop is fitted on the cylinder and moves back and forth relative to the post.

4. The guiding device for the stator of the automatic wire as claimed in claim 3, wherein the fixing loop includes a positioning trough formed on a top thereof and flushing with the slot of the cylinder so as to accommodate a key with the slot, and the key is locked in the cylinder so as to stop a rotation of the fixing loop around the cylinder.

5. The guiding device for the stator of the automatic wire as claimed in claim 3, wherein the fixing loop further includes a slit and a C-shaped clamping portion defined between the slit and the top of fixing loop.

* * * * *